US007290427B1

(12) United States Patent
Shifflett, Jr.

(10) Patent No.: US 7,290,427 B1
(45) Date of Patent: Nov. 6, 2007

(54) CLAMP RING WITH PRE-HEATER

(76) Inventor: James R. Shifflett, Jr., 4795 Berrytown Rd., Elkton, VA (US) 22827

( * ) Notice: Subject to any disclaimer, the term of this patent is extended or adjusted under 35 U.S.C. 154(b) by 0 days.

(21) Appl. No.: 11/277,577

(22) Filed: Mar. 27, 2006

(51) Int. Cl.
*B21D 37/16* (2006.01)

(52) U.S. Cl. ..... 72/342.8; 72/342.7

(58) Field of Classification Search ..... 72/342.1, 72/342.4, 342.5, 342.7, 342.8, 352, 360, 72/364

See application file for complete search history.

(56) References Cited

U.S. PATENT DOCUMENTS 2,760,543 A * 8/1956 Wood ..... 72/38
4,372,144 A * 2/1983 Valentine et al. ..... 72/352
4,444,039 A * 4/1984 Asari et al. ..... 72/342.5
6,960,746 B2 * 11/2005 Chen ..... 219/659
2006/0086169 A1 * 4/2006 Bergue et al. ..... 72/342.8

FOREIGN PATENT DOCUMENTS

JP 60-158940 * 8/1985

* cited by examiner

*Primary Examiner*—Ed Tolan

(57) ABSTRACT

A clamp ring for a forge die, the clamp ring comprising a substantially solid ring portion having a channel about the outer diameter and at least one flame aperture formed between the inside and the outside diameter and in fluid communication with the channel and a band portion having a inside diameter slightly larger than the outside diameter of the ring wherein the band portion is sized to fit over said ring portion, the ring portion having at least one aperture and a conduit attached thereto, whereby said band it attached to said ring such that combustible gas flows through said conduit into said channel and out of the at least one flame aperture.

3 Claims, 2 Drawing Sheets

CLAMP RING WITH PRE-HEATER

BACKGROUND OF THE INVENTION

1. Technical Field of Invention

This invention relates to clamps for forge dies and more specifically for an improved clamp ring having an integrated pre-heater.

2. Description of Prior Art

Forge dies are heated for two basic reasons. First is the material flow during the forge operation. The material being forged will flow better with a heated die, especially aluminum. If one forges aluminum, for example, without heating the dies you are more likely to get a non-fill condition, which means that the forged part will be incomplete in the corners, leading to scrapped parts. The second reason for heating the dies is that they will last longer if they are ran at an elevated temperature; cold dies will crack faster than a die that is heated.

Traditionally, dies were clamped to the forge press and heated using one of two different methods. In the first method, dies were clamped to the forge press with a clamp ring and then a separate heating ring was placed around the die. The heating ring was then connected to a propane gas supply and the resulting flames heated the die. In the second prior art method, two torches on either sides of the die acted as a heat source. Both of these heating methods make it difficult to precisely control the die temperature and the temperature must be controlled with a certain range, particularly for aluminum. If the dies are too cold you will get a non-fill as discussed above. If the dies are too hot then the metal will stick to the die surface as the forging process takes place; also causing parts to be scrapped due to a smeared appearance on the surface of the finished part.

In addition to requiring at least two separate components, such prior art methods are also inefficient because the flames of the heating elements were up to five (5) inches away form the forge die surface. Another drawback of the first prior art method is that it is difficult to hold the die heating ring in place while operating the forge press. As a result, the ring can shift position as the press was activated, causing the ring to be crushed and putting the operator in a dangerous situation as well as contributing to costly maintenance fees to repair broken dies. With the second "torch" method, the dies were not heated evenly, causing stress in the die that lead to premature failure.

SUMMARY OF INVENTION

A clamp ring for a forge die having an integrated means to heat the forge die, namely, integrated gas inlets, an internal gas distribution channel and at least one flame port.

BRIEF DESCRIPTION OF THE DRAWINGS

Specific embodiments of the invention have been chosen for purposes of illustration and description, and are shown in the accompanying drawing, forming a part of the specification wherein.

DESCRIPTION OF PREFERRED EMBODIMENTS

Figure 1:
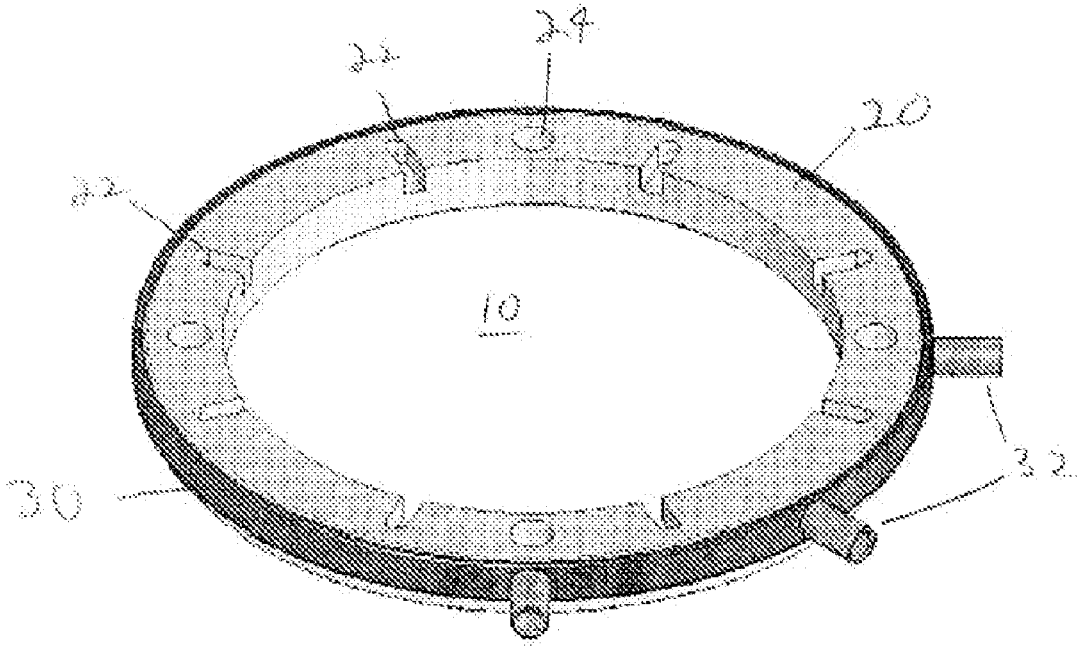
FIG. 1 is a perspective view of a clamp ring according to the invention.
Figure 2:
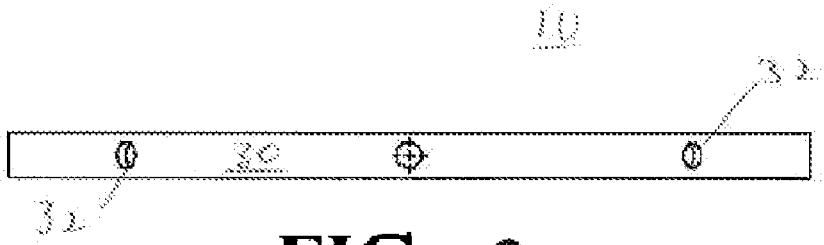
FIG. 2 is a side view of a clamp ring according to the invention.
Figure 3:
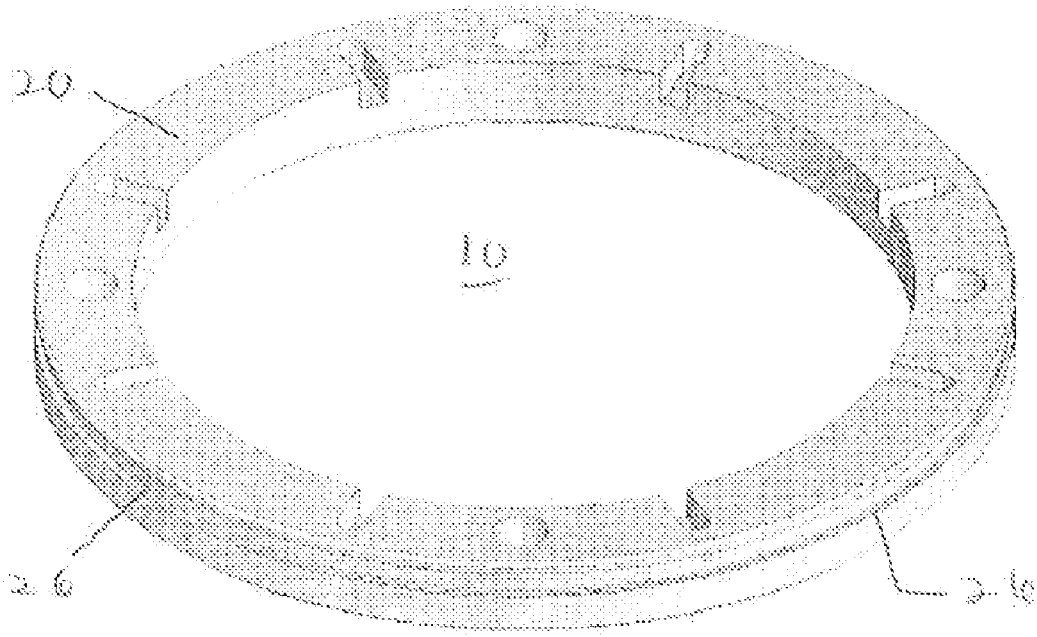
FIG. 3 is a perspective view of the ring portion of the clamp ring according to the invention.

The structure of the inventive clamp ring with pre-heater is best understood with reference to FIGS. 1 through 3, herein. The clamp ring 10 is generally formed from two components. Ring 20 is surrounded by band 30, which is attached and sealed flush to the ring by conventional methods, particularly by welding. The ring 20 has a gas groove 26 (shown in FIG. 3)) lathed or otherwise formed in its outer circumference (and generally sealed by band 30) for trapping the inputted gas and directing it to all of the flame ports 32 which are in fluid communication with said gas groove. As is shown in FIG. 1, the flame ports 32 are formed in the ring 20 such that there is an extended open portion on the top surface of the ring that allows the flames not be in direct contact with the forge, when in use. A least one, and preferably a plurality of, couplings 32 are attached, preferably by welding, to apertured portions of band 30 and serve as the inlet for the gas/air mixture by way of supply hoses that can be attached thereto. Finally, apertures 24 pass through the entirety of ring 20 and are provided for bolts that hold the ring and the die to the press bed.

The inventive clamp ring 10 offers the following advantages over prior art systems:

Reduction in set-up time: The clamp and heater elements are integrated into one piece rather than two;

Safety: The integrated heating element can no longer get between dies during press operations;

Maintenance: Crushed heating rings are eliminated and broken tooling reduced by use of integrated heating element; and Energy savings: It has been found that less gas is used to heat the forge dies because the flame(s) are closer to the die, thus improving efficiency.

In addition to the structures, sequences, and uses immediately described above, it will be apparent to those skilled in the art that other modifications and variations can be made the method of the instant invention without diverging from the scope, spirit, or teaching of the invention. In one such instance, although the inventive clamp ring is shown and described as a ring (toroidal) structure, other shapes and forms may be used. Therefore, it is the intention of the inventor that the description of instant invention should be considered illustrative and the invention is to be limited only as specified in the claims and equivalents thereto.

I claim:

1. A clamp ring for a forge die, the clamp ring comprising:

a) a substantially solid ring portion having a first inside and a first outside diameter, said ring portion further comprising a channel about said first outer diameter and at least one flame aperture formed between the first inside and the first outside diameter and in fluid communication with said channel; and b) a band portion having a second inside diameter slightly larger than said first outside diameter wherein said band portion is sized to fit over said ring portion, said ring portion having at least one aperture and a conduit attached thereto, whereby said band it attached to said ring such that combustible gas flows through said conduit into said channel and out of the at least one flame aperture.

2. The clamp ring of claim 1 wherein said solid ring portion has a top surface and a bottom surface, further comprising a plurality of apertures passing from the top surface to the bottom surface of the ring portion.

3. The clamp ring of claim 1 wherein the at least one flame aperture has one open surface corresponding to a horizontal plane of the ring portion.

* * * * *